United States Patent [19]

Courchesne

[11] 4,125,212

[45] Nov. 14, 1978

[54] PORTABLE UTILITY BAG

[76] Inventor: Luc Courchesne, 3492 Laval St., Montreal, Quebec, Canada, H2X 3C8

[21] Appl. No.: 774,054

[22] Filed: Mar. 3, 1977

[51] Int. Cl.[2] ..... A45F 3/02; A45F 3/04

[52] U.S. Cl. ..... 224/9; 224/26 H; 150/3

[58] Field of Search ..... 224/8 R, 9, 26 R, 26 C, 224/26 D, 26 K, 27, 31, 42.46 R, 46 R; 150/12, 1, 3, 1.7, 28 R, 42, 43, 44; 229/DIG. 3

[56] References Cited

U.S. PATENT DOCUMENTS

| | | | |
|---|---|---|---|
| 1,370,636 | 3/1921 | Dwyer | 224/46 R UX |
| 1,992,772 | 2/1935 | Ross | 224/46 R |
| 2,093,345 | 9/1937 | Wesolowski | 150/3 |
| 2,279,327 | 4/1942 | Kehr | 229/DIG. 3 UX |
| 2,451,142 | 10/1948 | Zimmern | 224/46 R |
| 3,158,300 | 11/1964 | Withee | 224/26 R |

FOREIGN PATENT DOCUMENTS

| | | | |
|---|---|---|---|
| 180,215 | 10/1935 | Switzerland | 224/5 R |

*Primary Examiner*—Trygve M. Blix
*Assistant Examiner*—Jerold M. Forsberg

[57] ABSTRACT

A portable utility bag of the packsack type adapted to vary its volume in relation with the content thereof at any moment and which includes a pair of tying bands defining a handle portion, or shoulder strap portions, to selectively use the bag as a handbag, shoulder bag or backpack. This portable utility bag includes a pair of opposite walls defining a common peripheral edge having a straight common edge portion, a stiffening band along this edge portion, a slit in one of the opposite walls along the stiffening band, a closure selectively closing this slit, at least a pair of loops fixed along an opposite edge portion of the bag relative to the straight common edge portion, and tying bands protruding from the ends of said stiffening band engaging in these loops and tied together to form a handle portion, or shoulder strap, between the two loops, and shoulder strap portions intermediate the stiffening band and the loops respectively.

3 Claims, 11 Drawing Figures

PORTABLE UTILITY BAG

This invention relates to a portable bag and, more particularly, to a portable utility bag, such as of the packsack type.

The bags of this type which have been proposed so far are of fixed volume and they are not specifically adapted to be used as handbag as well as shoulder bag, or backpack. Bags of the above type have not been adapted to be adjusted to the volume of the content therein at any given moment and this is often annoying, since the bag itself retains its full-size volume, even if it is almost empty, and since the things therein are too loose, subject to breakage, and they pile up, giving an untidy appearance.

It is a general object of the present invention to provide a portable utility bag of the above type, which is convertible at will to be used either as a backpack, a shoulder bag or as a handbag.

It is another general object of the present invention to provide a portable utility bag of the above type, the volume of which may be readily adjusted in relation with its content at any given moment.

It is a further general object of the present invention to provide a portable utility bag of the above type wherein the content thereof is tightly held to prevent breakage and to form a neat package.

It is a more specific object of the present invention to provide a portable utility bag of the above type which includes tying bands and a stiffening band arranged to cooperatively hold the bag in a reduced volume configuration and to define a handle portion or shoulder strap portions to selectively use the bag as a handbag, shoulder bag or a backpack.

The above and other objects and advantages of the present invention will be better understood with reference to the following detailed description of a preferred embodiment thereof which is illustrated, by way of example, in the accompanying drawings, in which:

FIG. 1 is a perspective view of a portable utility bag according to the present invention, shown empty;

FIGS. 2, 3, and 4 are side views of the bag of FIG. 1, shown empty, during filling and closed, respectively;

Figure 1:
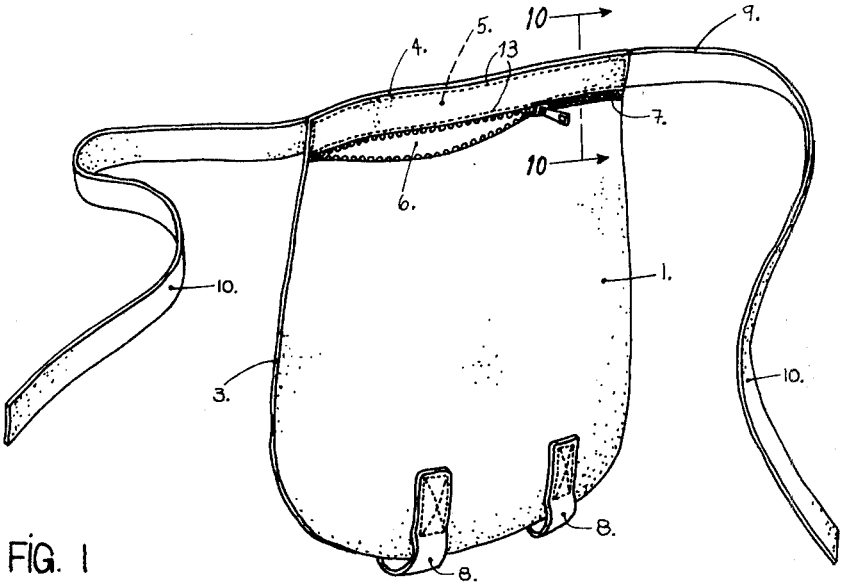
Figure 2:
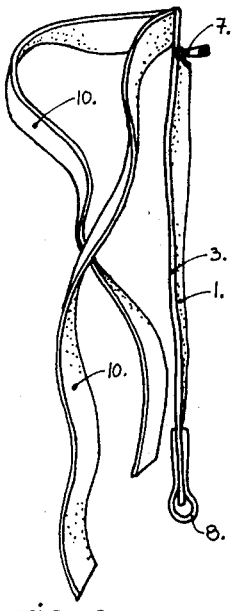
Figure 3:
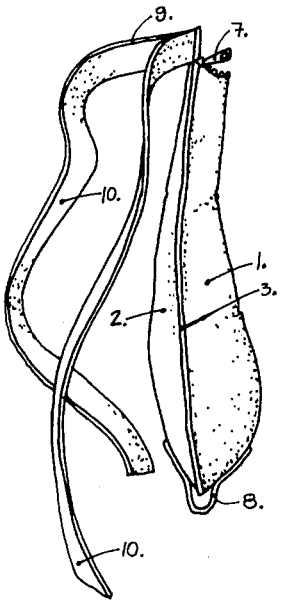

The illustrated portable utility bag 1 includes a pair of opposite walls 1 and 2 which are sewn to each other along a common peripheral edge 3 to form a flexible envelope. The latter includes a straight common edge portion 4.

A single band 9, of flexible material, is fixed along the straight common edge portion 4 and includes opposite end portions 10 projecting from the opposite side edges of the bag and forming a pair of tying bands.

A stiffening band 5, of leather or the like, is positioned in the pocket defined by side wall 2, band 9 and stitching line 13 and extends lengthwise along the straight common edge portion 4 from one to the other side edge of the bag.

A slit 6 is made in the side wall 1 of the bag and extends adjacent and lengthwise along the inner longitudinal edge of stiffening band 5. A zipper 7, or other type of closure, is sewn to selectively close the slit 6.

A pair of loops, or straps 8, extend lengthwise transversely of the peripheral edge 3 and have their opposite ends sewn to the opposite side walls 1 and 2, respectively, of the bag. These loops 8 are laterally spaced apart from each other along the peripheral edge 3 and peripherally opposite the straight common edge portion 4.

Figure 4:
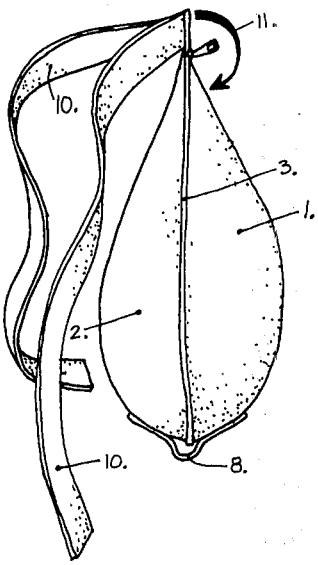
Figure 5:
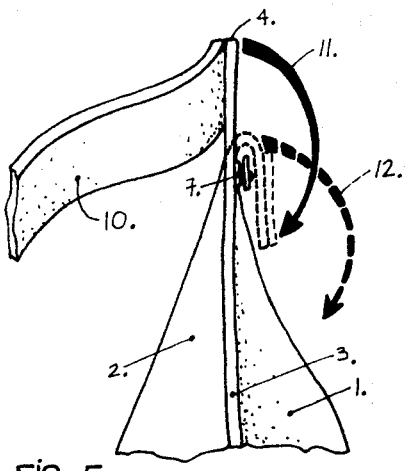
FIG. 5 is an enlarged partial side view of part of the bag illustrating the closure of the same.
Figure 6:
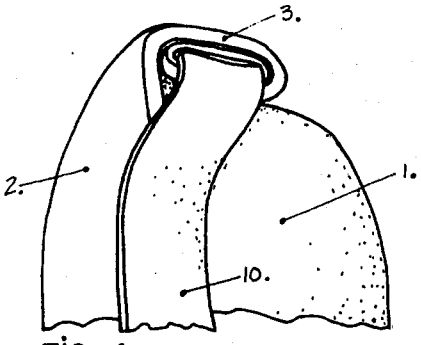
FIG. 6 is a view corresponding to FIG. 5 but with the closure completed.
Figure 7:
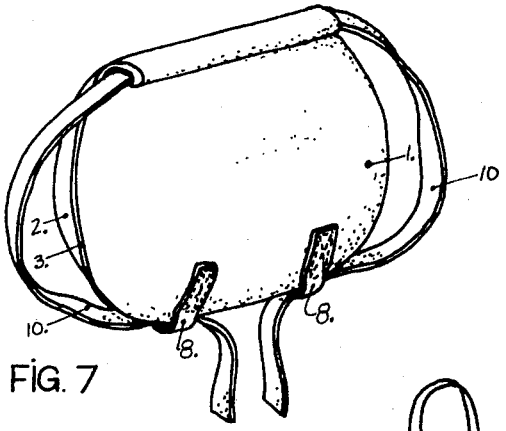
FIG. 7 is a perspective view of the portable utility bag with the closure completed.
Figure 11:
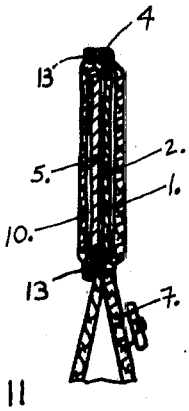
FIG. 11 is a cross-section on line 10—10 of FIG. 1.
Figure 8:
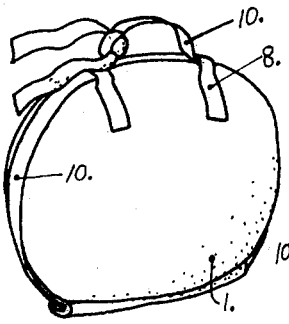
FIG. 8 is a perspective view of the portable utility bag in the configuration to be used as a handbag.
Figure 9:
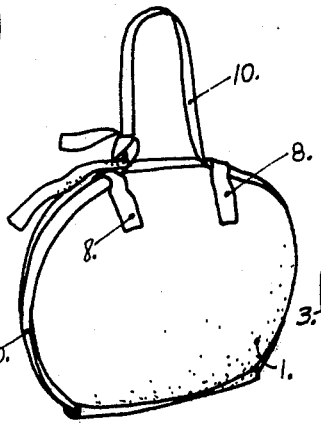
FIG. 9 is a perspective view of the bag in the configuration to be used as a shoulder bag.
Figure 10:
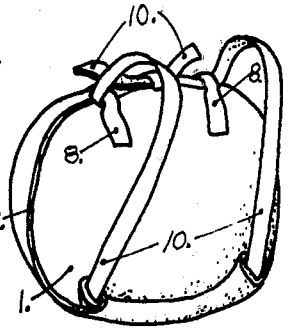
FIG. 10 is a perspective view of the portable utility bag in the configuration to be used as a backpack.

After the desired articles are placed in the bag, the closure 7 is operated to close the slit 6 and, thus, the bag. The stiffening band 5 and the superposed single band 9 are rolled laterally against the side wall 1 of the bag, as shown by the arrows 11 and 12 in FIGS. 4 and 5 to thereby cover and protect closure 7. With appropriate rolling, the bag takes a compact form with the articles therein firmly held by the resulting effective decrease in volume of the bag. The tying bands 10 are engaged each in the nearest loop 8 and they are tied between the two loops, as shown in FIGS. 8, 9, and 10. The tying bands 10 thus cooperatively form a handle portion, or shoulder strap, between the two loops 8, and a pair of shoulder strap portions between the stiffening band 5 and the loops 8, respectively.

Thus, the bag according to the present invention, after its reversal, may be carried as a handbag, as shown in FIG. 8, by means of this handle portion, or it may be carried as a shoulder bag, as shown in FIG. 9, or as backpack, on one's back by passing the shoulder strap portions over the shoulders, as shown in FIG. 10.

The bag, and more particularly the two side walls 1 and 2, the single band 9, and the loops 8 may be made of any conventional wear-resistant fabric or flexible material.

It must be noted that the rolled portion of the bag is operatively at the bottom when carrying the bag and the tension then in the bands 10 keeps, with the help of the stiffening band 5, the bag from unrolling.

What I claim is:

1. A portable utility bag having an upper end and a lower end and comprising a flexible envelope having opposite walls cooperatively defining a common and closed peripheral edge all around said envelope, said common and closed peripheral edge including a first straight common edge portion at said lower end of the bag and a second straight common edge portion at the upper end of said bag, a stiffening band fixedly secured to said envelope and extending lengthwise along said first straight common edge portion, a pair of loops fixed to said envelope and projecting from said second straight common edge portion and spaced apart along said second straight common edge portion, a pair of tying bands secured to said envelope, projecting endwise from the latter and from the opposite ends respectively of said stiffening band, operatively engageable in said loops respectively and adapted to be tied one to the other intermediate said loops to thereby define tying band portions extending from the ends of the stiffening band to said loops and second tying band portion extending between the two loops, said tying bands forming at the upper end of said bag a carrying handle or a single shoulder strap intermediate said loops or a pair of shoulder straps longitudinally extending between said stifening band and said loops, one of said walls having a slit forming an access opening for the envelope and a closure for said slit, the lower end portion of said bag being rollable around said stiffening band to decrease the effective volume of the bag and keep the contents of the bag in tight condition, said tying bands, when exerting an upward pull on the said stiffening band, keep the latter flat against the bottom and contents of the bag thereby preventing unrolling of the lower end portion of said bag.

2. A portable utility bag as defined in claim 1, wherein a single band of material is fixed along said straight common edge portion in superposed relationship with said stiffening band and includes opposite end portions projecting from the opposite ends of said stiffening band and constituting said tying bands.

3. A portable utility bag as defined in claim 1, wherein said slit is made in said one wall along and inwardly of and adjacent said stiffening band.

* * * * *